US006655480B1

(12) United States Patent
Boyd

(10) Patent No.: US 6,655,480 B1
(45) Date of Patent: Dec. 2, 2003

(54) CUTTING INSERT FOR PERCUSSION DRILL BIT

(75) Inventor: Micheal D. Boyd, Rogers, AR (US)

(73) Assignee: Kennametal Inc., Latrobe, PA (US)

( * ) Notice: Subject to any disclaimer, the term of this patent is extended or adjusted under 35 U.S.C. 154(b) by 0 days.

(21) Appl. No.: 09/680,360

(22) Filed: Oct. 5, 2000

(51) Int. Cl.[7] ..... E21B 10/56
(52) U.S. Cl. ..... 175/420.1; 175/374; 175/426
(58) Field of Search ..... 175/420.1, 426, 175/374, 430, 420.2, 415

(56) References Cited

U.S. PATENT DOCUMENTS

| | | | | | |
|---|---|---|---|---|---|
| 4,607,712 | A | * | 8/1986 | Larsson | 175/426 |
| 5,323,865 | A | | 6/1994 | Isbell et al. | |
| 5,415,244 | A | * | 5/1995 | Portwood | 175/374 |
| 5,492,186 | A | | 2/1996 | Overstreet et al. | |
| 5,813,485 | A | * | 9/1998 | Portwood | 175/430 |
| 5,868,213 | A | | 2/1999 | Cisneros et al. | |
| 5,881,828 | A | | 3/1999 | Fischer et al. | |
| 5,915,486 | A | * | 6/1999 | Portwood et al. | 175/374 |
| 5,971,087 | A | | 10/1999 | Chaves | |
| 6,029,759 | A | | 2/2000 | Sue et al. | |
| 6,119,798 | A | * | 9/2000 | Fischer et al. | 175/420.2 |
| 6,161,634 | A | * | 12/2000 | Minikus et al. | 175/331 |
| 6,199,645 | B1 | | 3/2001 | Anderson et al. | 175/426 |
| 6,227,318 | B1 | * | 5/2001 | Siracki | 175/430 |
| 6,241,035 | B1 | * | 6/2001 | Portwood | 175/374 |
| 6,290,008 | B1 | * | 9/2001 | Portwood et al. | 175/426 |

FOREIGN PATENT DOCUMENTS

| | | |
|---|---|---|
| GB | 2334278 | 8/1999 |
| GB | 2344840 | 6/2000 |
| GB | 2345503 | 7/2000 |
| GB | 2357532 | 6/2001 |
| WO | 9612085 | 4/1996 |
| WO | 9612086 | 4/1996 |

OTHER PUBLICATIONS

PCT Search Report mailed Jan. 22, 2002, in PCT/US01/29821, international filing date Sep. 24, 2001.

* cited by examiner

*Primary Examiner*—Hoang Dang
(74) *Attorney, Agent, or Firm*—Kevin P. Weldon

(57) ABSTRACT

A cutting insert for a gauge row of a percussion drill bit includes a generally cylindrical mounting portion extending along a central axis and a cutting head extending from the mounting portion. The cutting head has an exposed surface forming a non-symmetrical dome shape such that the working portion of the cutting head is enlarged with respect to a standard dome shape and a trailing portion of the cutting head is reduced with respect to a standard dome shape. The cutting head has an inner edge and an outer edge. The exposed surface is non-symmetrical along a central plane which bisects the working portion and the trailing portion. The exposed surface is symmetrical in a second plane perpendicular to the central plane such that the exposed surface forms an arc of constant radius from the inner edge to the outer edge in the second plane.

22 Claims, 3 Drawing Sheets

CUTTING INSERT FOR PERCUSSION DRILL BIT

TECHNICAL FIELD

The present invention relates a cutting insert for a percussion drill bit.

BACKGROUND ART

In general, there are four different face designs used in the hammer bit industry. They are: drop center, concave, flat face and convex (sometimes called double bevel or double gauge). Each has its own advantages and disadvantages for different applications. The placement, diameter, shape and number of tungsten carbide inserts used on these bits vary by face design and manufacturer. In general, the smaller the carbide diameter, the faster the penetration rate. The trade-off with the smaller carbides is that they wear out faster and require more frequent re-sharpening. Larger carbides, while giving up penetration rate, will last longer and are less prone to shear failure.

Most face designs incorporate large diameter carbides on the gauge row for greater wear resistance and smaller diameter carbides on the inner rows where wear resistance is minimized as a result of reduced speed of the inserts closer to the longitudinal axis of the bit. The most popular carbide designs are dome-shaped and conical-shaped. Dome-shaped carbides are standard on most bits and conical carbides can be ordered as optional equipment. The advantages of conical carbides are higher penetration rate, bigger chip size and more efficient rock breakage. The primary disadvantage of conical carbides is that they are more fragile than dome-shaped carbides and are therefore used primarily in soft consolidated formations only.

DTH (down the hole) carbides are subject to various types of wear during drilling. The majority of the wear is caused by abrasion as the bit rotates against the bottom of the hole and against the hole wall, causing "wear flats." If wear becomes excessive, bit life and hammer performance can deteriorate. When a carbide is excessively worn, stress is higher on the carbide and can lead to premature failure.

The two types of wear addressed by the present invention are referred to as "frontal wear" and "gauge wear." Frontal wear occurs when drilling in hard rock, such as granite. In this case, the gauge row carbides will wear faster than front carbides because of the greater distance covered around the outside of the bit during rotation. Gauge wear occurs when drilling in abrasive rock with a high quartz content. An "anti-taper" develops which diminishes the clearance of the bit body caused by unusually high wear to the gauge row. The typical solutions to these problems are: changing the grade of carbide used in the gauge row; increasing the diameter used in the gauge row; re-sharpening the inserts; or decreasing the penetration rate.

Accordingly, it is desirable to provide an improved gauge row cutting insert with extended service life without loss of penetration rate.

DISCLOSURE OF INVENTION

The present invention overcomes the above-referenced shortcomings of prior art cutting inserts by providing a cutting insert having the service life expectancy of a dome-shaped insert and the rate of penetration (ROP) of a cone-shaped insert. The insert has a cutting head which is a non-symmetrical dome shape, wherein carbide is reduced in the trailing portion and increased in the working portion of the cutting head.

More specifically, the present invention provides a cutting insert for a gauge row (or other location) of a percussion drill bit, including a generally cylindrical mounting portion extending along a central axis and a cutting head extending from the mounting portion. The cutting head has an exposed surface forming a non-symmetrical dome shape such that a working portion of the cutting head is enlarged with respect to a standard dome shape and a trailing portion of the cutting head is reduced with respect to a standard dome shape. The cutting head has an inner edge and an outer edge. The exposed surface is non-symmetrical along a central plane which bisects the working portion and trailing portion. The exposed surface is symmetrical in a second plane perpendicular to the central plane such that the exposed surface forms an arc of constant radius from the inner edge to the outer edge.

Preferably, the exposed surface is symmetrical in any intersecting plane which is perpendicular to the central plane such that the exposed surface forms an arc of constant radius in any such plane from the inner edge to the outer edge.

The invention also provides a percussion drill bit including a shaft with a boring head positioned at a distal end of the shaft and having a longitudinal axis. The boring head has an upwardly facing upper end with a plurality of holes formed therein. The holes include a gauge row of holes. A cutting insert, as described above, is positioned in each hole of the gauge row of holes.

Accordingly, an object of the invention is to provide an improved cutting insert for a percussion drill bit wherein the cutting insert has an exposed surface which is non-symmetrical in a plane bisecting the working portion and trailing portion, and symmetrical in a second plane perpendicular to the central plane such that the exposed surface forms an arc of constant radius from the inner edge to the outer edge in the second plane.

Another object of the invention is to provide a cutting insert for a gauge row of a percussion drill bit having a cutting head with an exposed surface which is non-symmetrical along a central plane bisecting the working portion and trailing portion, and symmetrical in any intersecting plane which is perpendicular to the central plane such that the exposed surface forms an arc of constant radius in any such plane from the inner edge to the outer edge.

The above objects and other objects, features and advantages of the present invention are readily apparent from the following detailed description of the best mode for carrying out the invention when taken in connection with the accompanying drawings.

BEST MODE FOR CARRYING OUT THE INVENTION

Figure 1:
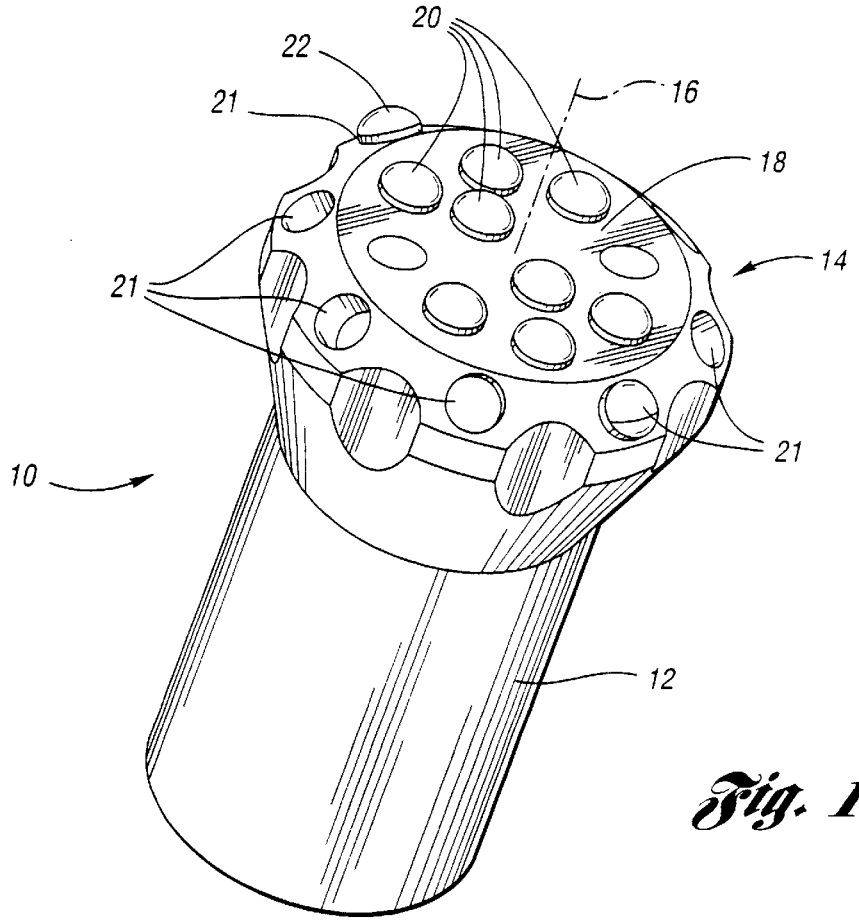
FIG. 1 shows a perspective view of a percussion drill bit in accordance with the present invention.

FIG. 1 shows a perspective view of a percussion drill bit 10 in accordance with the present invention. The percussion drill bit 10 includes a shaft 12 with a boring head 14 positioned at a distal end of the shaft 12 and having a longitudinal axis 16. The boring head 14 has an upwardly facing upper end 18 with a plurality of holes formed therein. These holes are configured to receive tungsten carbide inserts 20. A gauge row 22 of inserts is provided around the peripheral edges of the upper end 18 of the boring head 14.

A gauge row insert 22 in accordance with the present invention is shown in more detail in FIGS. 2–13. Each gauge row insert 22 includes a generally cylindrical mounting portion 24 extending along a central axis 26, and a cutting head 28 extending from the mounting portion 24. The cutting head 28 has an exposed surface 30 forming a non-symmetrical dome shape such that a working portion 32 of the cutting head 28 is enlarged with respect to a standard dome shape D, as shown most clearly in FIG. 13, and a trailing portion 34 of the cutting head 28 is reduced with respect to a standard dome shape D, as also most clearly shown in FIG. 13.

Figure 5:
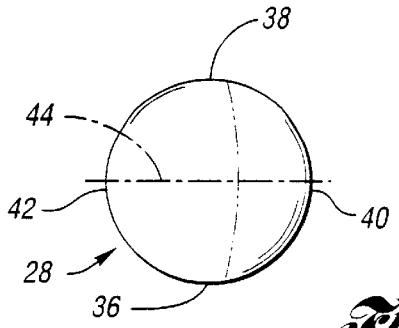
FIG. 5 shows an overhead plan view of the cutting insert of FIG. 2.
Figure 6:
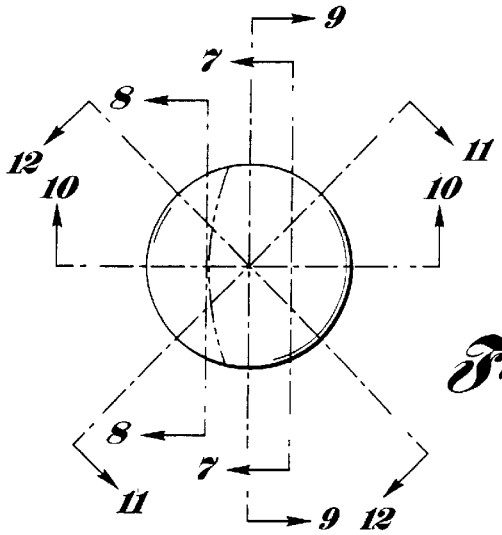
FIG. 6 shows an overhead plan view of the cutting insert of FIG. 2.

As shown in FIG. 5, the cutting head 28 has an inner edge 36, an outer edge 38, a forward edge 40, and a rearward edge 42.

Figure 10:
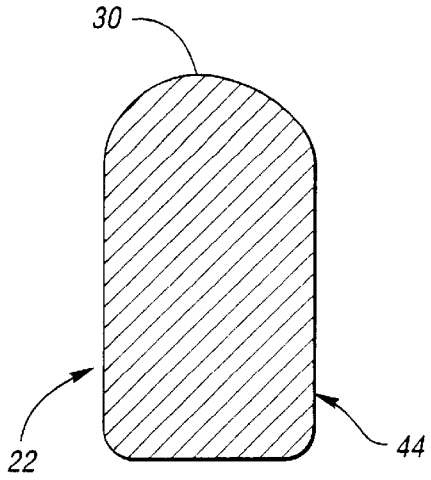
FIG. 10 shows a sectional view taken at line 10—10 of FIG. 6.
Figure 11:
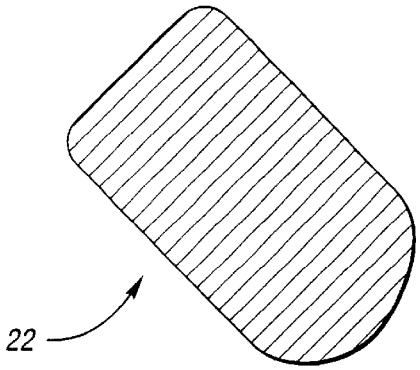
FIG. 11 shows a sectional view taken at line 11—11 of FIG. 6.
Figure 12:
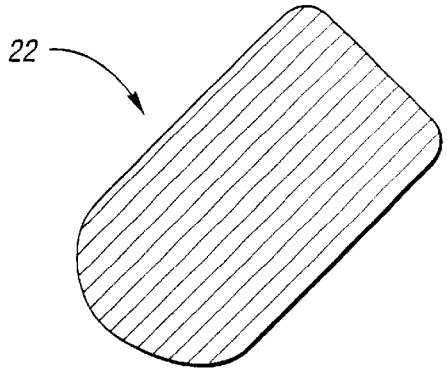
FIG. 12 shows a sectional view taken at line 12—12 of FIG. 6.
Figure 13:
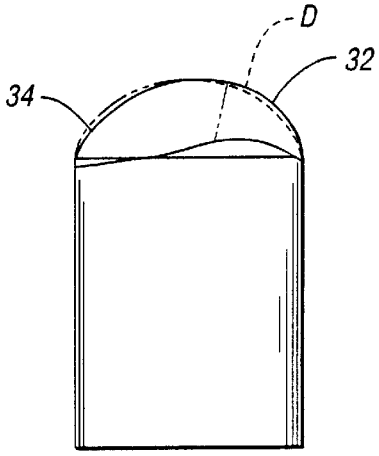
FIG. 13 shows a side view of the cutting insert of FIG. 2, with a standard dome-shaped configuration shown in phantom.

The exposed surface 30 is non-symmetrical along a central plane 44 which bisects the working portion 32 and the trailing portion 34 (i.e., the central plane splits the working portion 32 and trailing portion 34 each in half, and is oriented tangential to a radius extending from the longitudinal axis 16 of the drill bit 10.). The central plane 44 is co-extensive with the cross-section 10—10, shown in FIG. 10. As shown in FIG. 10, the exposed surface 30 of the cutting head 28 does not have a constant radius, and is therefore non-symmetrical in this plane 44.

Figure 7:
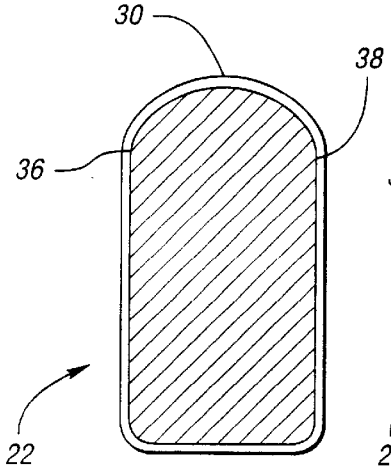
FIG. 7 shows a cross-sectional view taken at line 7—7 of FIG. 6.
Figure 8:
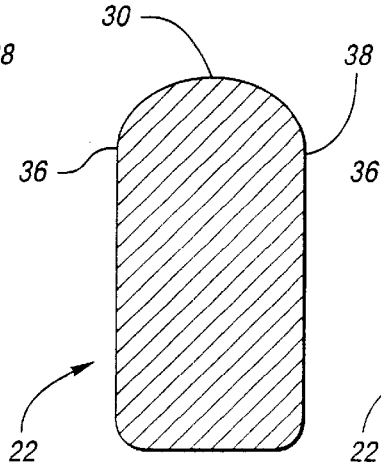
FIG. 8 shows a cross-sectional view taken at line 8—8 of FIG. 6.
Figure 9:
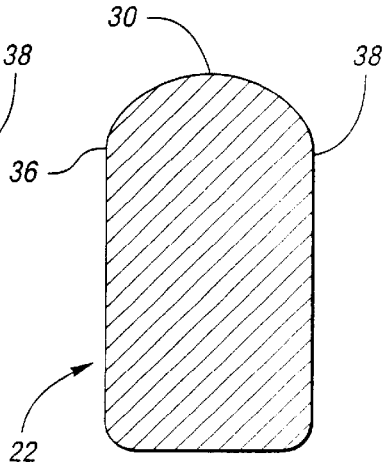
FIG. 9 shows a sectional view taken at line 9—9 of FIG. 6.

The exposed surface 30 is symmetrical in any intersecting plane which is perpendicular to the central plane 44 such that the exposed surface 30 forms an arc of constant radius in any such plane from the inner edge 36 to the outer edge 38. Examples of such intersecting planes through which the exposed surface 30 is symmetrical are shown in FIGS. 7, 8 and 9. FIG. 9 illustrates such a perpendicular intersecting plane that intersects the central axis 44 of the cutting insert. FIG. 7 illustrates another intersecting plane that is perpendicular to the central plane and is more near the central axis than it is near the forward edge 40 or rearward edge 42. The intersecting plane illustrated in FIG. 8 is also more near the central axis but on the opposite side of the central axis. As shown in FIGS. 7, 8 and 9, the exposed surface 30 has an arc of constant radius from the inner edge 36 to the outer edge 38.

Preferably, each insert 22 comprises a single tungsten carbide component.

Figure 2:
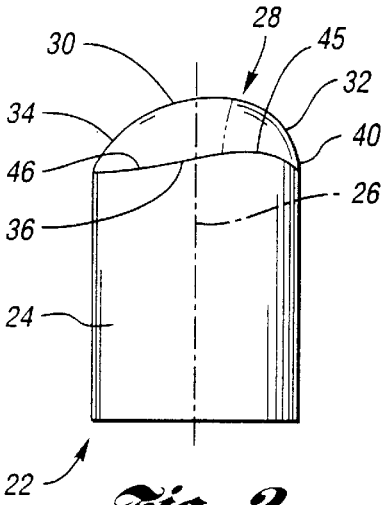
FIG. 2 shows a side view of a cutting insert for use with the drill bit of FIG. 1.
Figure 3:
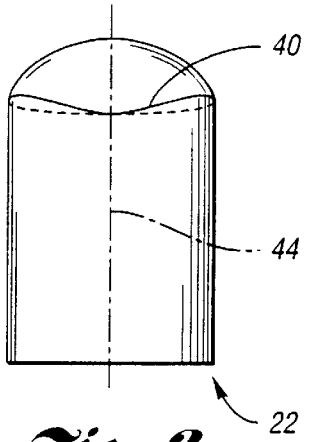
FIG. 3 shows a front view of the cutting insert of FIG. 2.
Figure 4:
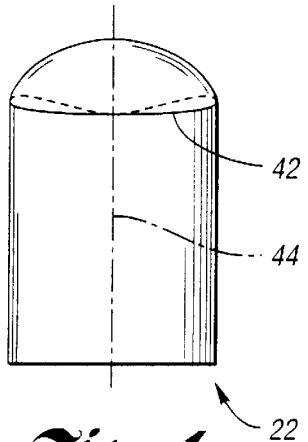
FIG. 4 shows a rear view of the cutting insert of FIG. 2.

As shown in FIG. 2, the inner and outer edges 36,38 are non-linear in side view orthogonal to the central axis 26. The inner and outer edges 36,38 curve from the forward edge 40 upwardly along the working portion 32 and taper downwardly along the trailing portion 34 in side view. Accordingly, the inner and outer edges 36,38 have a curved hump 45 and a flat portion 46 which tapers downwardly. In this configuration, after the tool has been worn, it may be machined down to a standard dome shape for further use.

In essence, the present invention moves material from the trailing portion to the working portion of the cutting head to provide substantially the same benefits of a dome-shaped and cone-shaped configuration by providing improved bit rate of penetration and improved part life.

Wherein at least a substantial majority of planes perpendicular to the central plane are symmetrical in shape. As illustrated in FIGS. 7–9, any plane perpendicular to the central plane 44 is symmetrical in shape. As illustrated by FIG. 10, the exposed surface 30 is non-symmetrical in the central plane 44. Also, the exposed surface 30 is non-symmetrical in any plane coextensive with the central axis and non-perpendicular to the central plane 44, such as the planes illustrated by the sectional views of FIGS. 11 and 12. This configuration helps relieve stress on the trailing portion and increase the wear life of the working portion of the insert.

While the best mode for carrying out the invention has been described in detail, those familiar with the art to which this invention relates will appreciate alternative designs and embodiments for practicing the invention within the scope of the appended claims.

What is claimed is:

1. A cutting insert for a gauge row of a percussion drill bit, comprising:

a generally cylindrical mounting portion extending along a central axis and a cutting head extending from the mounting portion, said cutting head having an exposed surface forming a non-symmetrical dome shape such that a working portion of the cutting head is enlarged with respect to a standard dome shape and a trailing portion of the cutting head is reduced with respect to a standard dome shape, said cutting head having an inner edge and an outer edge; and wherein said exposed surface is non-symmetrical along a central plane which bisects the working portion and the trailing portion, and said exposed surface is symmetrical in a second plane perpendicular to the central plane such that the exposed surface forms an arc of constant radius from the inner edge to the outer edge in the second plane.

2. The cutting insert of claim 1, wherein said exposed surface is symmetrical in any intersecting plane which is perpendicular to the central plane such that the exposed surface forms an arc of constant radius in any such plane from the inner edge to the outer edge.

3. The cutting insert of claim 1, wherein said mounting portion and cutting head comprise a single tungsten carbide component.

4. The cutting insert of claim 1, wherein said exposed surface is non-symmetrical in any plane coextensive with the central axis and non-perpendicular to the central plane.

5. A percussion drill bit, comprising:

a shaft with a boring head positioned at a distal end of the shaft and having a longitudinal axis, said boring head having an upwardly facing upper end with a plurality of holes formed therein, said holes including a gauge row of holes;

a cutting insert positioned in each hole of said gauge row of holes, each said cutting insert having a generally cylindrical mounting portion extending along a central axis and a cutting head extending from the mounting portion, said cutting head having an exposed surface forming a non-symmetrical dome shape such that a working portion of the cutting head is enlarged with respect to a standard dome shape and a trailing portion of the cutting head is reduced with respect to a standard dome shape, said cutting head having an inner edge and an outer edge, wherein said exposed surface is non-symmetrical along a central plane which bisects the working portion and the trailing portion, and said exposed surface is symmetrical in a second plane perpendicular to the central plane such that the exposed surface forms an arc of constant radius from the inner edge to the outer edge in the second plane.

6. The percussion drill bit of claim 5, wherein said exposed surface is symmetrical in any intersecting plane which is perpendicular to the central plane such that the exposed surface forms an arc of constant radius in any such plane from the inner edge to the outer edge.

7. The percussion drill bit of claim 5, wherein said mounting portion and cutting head comprise a single tungsten carbide component.

8. The cutting insert of claim 5, wherein said exposed surface is non-symmetrica in any plane coextensive with the central axis and non-perpendicular to the central plane.

9. A cutting insert for a percussion drill bit, comprising:

a generally cylindrical mounting portion extending along a central axis and a cutting head extending from the mounting portion, said cutting head having an exposed surface forming a non-symmetrical dome shape such that a working portion of the cutting head is enlarged with respect to a standard dome shape and a trailing portion of the cutting head is reduced with respect to a standard dome shape, said cutting head having an inner edge and an outer edge;

wherein said exposed surface is non-symmetrical along a central plane which bisects the working portion and trailing portion, and said exposed surface is symmetrical in any plane perpendicular to the central plane such that the exposed surface forms an arc of constant radius from the inner edge to the outer edge in any such perpendicular plane.

10. The cutting insert of claim 9, wherein said mounting portion and cutting head comprise a single tungsten carbide component.

11. The cutting insert of claim 9, wherein said inner and outer edges are non-linear in side view orthogonal to the central axis.

12. The cutting insert of claim 9, wherein said inner and outer edges curve from a forward edge upwardly along the working portion and taper downwardly along the trailing portion to the rearward edge in said side view orthogonal to the central axis.

13. The percussion drill bit of claim 9, wherein said exposed surface is non-symmetrical in any plane coextensive with the central axis and non-perpendicular to the central plane.

14. A cutting insert for a gauge row of a percussion drill bit, comprising:

a generally cylindrical mounting portion extending along a central axis and a cutting head extending from the mounting portion, said cutting head having an exposed surface forming a non-symmetrical dome shape such that a working portion of the cutting head is enlarged with respect to a standard dome shape and a trailing portion of the cutting head is reduced with respect to a standard dome shape, said cutting head having an inner edge and an outer edge; and wherein said exposed surface is non-symmetrical along a central plane which bisects the working portion and the trailing portion, and said exposed surface is symmetrical in a second plane perpendicular to the central plane such that the exposed surface forms an arc of constant radius from the inner edge to the outer edge in the second plane, wherein said inner and outer edges are non-linear in side view orthogonal to the central axis.

15. A cutting insert for a gauge row of a percussion drill bit, comprising:

a generally cylindrical mounting portion extending along a central axis and a cutting head extending from the mounting portion, said cutting head having an exposed surface forming a non-symmetrical dome shape such that a working portion of the cutting head is enlarged with respect to a standard dome shape and a trailing portion of the cutting head is reduced with respect to a standard dome shape, said cutting head having an inner edge and an outer edge; and wherein said exposed surface is non-symmetrical along a central plane which bisects the working portion and the trailing portion, and said exposed surface is symmetrical in a second plane perpendicular to the central plane such that the exposed surface forms an arc of constant radius from the inner edge to the outer edge in the second plane, wherein said inner and outer edges curve from a forward edge upwardly along the working portion and taper downwardly along the trailing portion to the rearward edge in said side view orthogonal to the central axis.

16. A percussion drill bit, comprising:

a shaft with a boring head positioned at a distal end of the shaft and having a longitudinal axis, said boring head having an upwardly facing upper end with a plurality of holes formed therein, said holes including a gauge row of holes;

a cutting insert positioned in each hole of said gauge row of holes, each said cutting insert having a generally cylindrical mounting portion extending along a central axis and a cutting head extending from the mounting portion, said cutting head having an exposed surface forming a non-symmetrical dome shape such that a working portion of the cutting head is enlarged with respect to a standard dome shape and a trailing portion of the cutting head is reduced with respect to a standard dome shape, said cutting head having an inner edge and an outer edge, wherein said exposed surface is non-symmetrical along a central plane which bisects the working portion and the trailing portion, and said exposed surface is symmetrical in a second plane perpendicular to the central plane such that the exposed surface forms an arc of constant radius from the inner edge to the outer edge in the second plane, wherein said inner and outer edges are non-linear in side view orthogonal to the central axis.

17. A percussion drill bit, comprising:

a shaft with a boring head positioned at a distal end of the shaft and having a longitudinal axis, said boring head having an upwardly facing upper end with a plurality of holes formed therein, said holes including a gauge row of holes;

a cutting insert positioned in each hole of said gauge row of holes, each said cutting insert having a generally cylindrical mounting portion extending along a central axis and a cutting head extending from the mounting portion, said cutting head having an exposed surface forming a non-symmetrical dome shape such that a working portion of the cutting head is enlarged with respect to a standard dome shape and a trailing portion of the cutting head is reduced with respect to a standard dome shape, said cutting head having an inner edge and an outer edge, wherein said exposed surface is non-symmetrical along a central plane which bisects the working portion and the trailing portion, and said exposed surface is symmetrical in a second plane perpendicular to the central plane such that the exposed surface forms an arc of constant radius from the inner edge to the outer edge in the second plane, wherein said inner and outer edges curve from a forward edge upwardly along the working portion and taper downwardly along the trailing portion to the rearward edge in said side view orthogonal to the central axis.

18. A cutting insert for a gauge row of a percussion drill bit, comprising:

a generally cylindrical mounting portion extending along a central axis and a cutting head extending from the mounting portion, said cutting head having an exposed surface forming a non-symmetrical dome shape such that a working portion of the cutting head is enlarged with respect to a standard dome shape and a trailing portion of the cutting head is reduced with respect to a standard dome shape, said cutting head having an inner edge and an outer edge; and wherein said exposed surface is non-symmetrical along a central plane which bisects the working portion and the trailing portion, and said exposed surface is symmetrical in a second plane perpendicular to the central plane and more near the central axis than said second plane is near a forward edge or a rearward edge such that the exposed surface forms an arc of constant radius from the inner edge to the outer edge in the second plane.

19. A cutting insert for a gauge row of a percussion drill bit, comprising:

a generally cylindrical mounting portion extending along a central axis and a cutting head extending from the mounting portion, said cutting head having an exposed surface forming a non-symmetrical dome shape such that a working portion of the cutting head is enlarged with respect to a standard dome shape and a trailing portion of the cutting head is reduced with respect to a standard dome shape, said cutting head having an inner edge and an outer edge; a wherein said exposed surface is non-symmetrical along a central plane which bisects the working portion and the trailing portion, and said exposed surface is symmetrical in a second plane perpendicular to the central plane and intersecting said central axis such that the exposed surface forms an arc of constant radius from the inner edge to the outer edge in the second plane.

20. A percussion drill bit, comprising:

a shaft with a boring head positioned at a distal end of the shaft and having a longitudinal axis, said boring head having an upwardly facing upper end with a plurality of holes formed therein, said holes including a gauge row of holes;

a cutting insert positioned in each hole of said gauge row of holes, each said cutting insert having a generally cylindrical mounting portion extending along a central axis and a cutting head extending from the mounting portion, said cutting head having an exposed surface forming a non-symmetrical dome shape such that a working portion of the cutting head is enlarged with respect to a standard dome shape and a trailing portion of the cutting head is reduced with respect to a standard dome shape, said cutting head having an inner edge and an outer edge, wherein said exposed surface is non-symmetrical along a central plane which bisects the working portion and the trailing portion, and said exposed surface is symmetrical in a second plane perpendicular to the central plane and more near the central axis than said second plane is near a forward edge or a rearward edge, such that the exposed surface forms an arc of constant radius from the inner edge to the outer edge in the second plane.

21. A cutting insert for a gauge row of a percussion drill bit, comprising:

a generally cylindrical mounting portion extending along a central axis and a cutting head extending from the mounting portion, said cutting head having an exposed surface forming a non-symmetrical dome shape such that a working portion of the cutting head is enlarged with respect to a standard dome shape and a trailing portion of the cutting head is reduced with respect to a standard dome shape, said cutting head having an inner edge and an outer edge; and wherein said exposed surface is non-symmetrical along a central plane which bisects the working portion and the trailing portion, and said exposed surface is symmetrical in at least a substantial majority of all planes perpendicular to the central plane such that the exposed surface forms an arc of constant radius from the inner edge to the outer edge in the second plane.

22. A percussion drill bit, comprising:

a shaft with a boring head positioned at a distal end of the shaft and having a longitudinal axis, said boring head having an upwardly facing upper end with a plurality of holes formed therein, said holes including a gauge row of holes;

a cutting insert positioned in each hole of said gauge row of holes, each said cutting insert having a generally cylindrical mounting portion extending along a central axis and a cutting head extending from the mounting portion, said cutting head having an exposed surface forming a non-symmetrical dome shape such that a working portion of the cutting head is enlarged with respect to a standard dome shape and a trailing portion of the cutting head is reduced with respect to a standard dome shape, said cutting head having an inner edge and an outer edge, wherein said exposed surface is non-symmetrical along a central plane which bisects the working portion and the trailing portion, and said exposed surface is symmetrical in at least a substantial majority of all planes perpendicular to the central plane such that the exposed surface forms an arc of constant radius from the inner edge to the outer edge in the second plane.

* * * * *